US005743317A

United States Patent [19]

Beringer et al.

[11] Patent Number: 5,743,317

[45] Date of Patent: Apr. 28, 1998

[54] IMPACT DETECTION SYSTEM FOR INDUSTRIAL DOORS

[75] Inventors: Mark D. Beringer, Sherril; David P. Leppert, Zwingle, both of Iowa; Peter S. Schulte, East Dubuque, Ill.

[73] Assignee: Rite-Hite Corporation, Milwaukee, Wis.

[21] Appl. No.: 686,996

[22] Filed: Jul. 24, 1996

[51] Int. Cl.[6] ..... G08B 13/08

[52] U.S. Cl. ..... 160/10; 160/3; 160/238; 160/274; 250/221; 340/545

[58] Field of Search ..... 160/3, 8, 9, 238, 160/267.1, 273.1, 274, 10; 250/221, 222.1; 340/545, 555, 556, 557

[56] References Cited

U.S. PATENT DOCUMENTS

| | | | |
|---|---|---|---|
| Re. 34,665 | 7/1994 | Strand | 250/221 |
| 3,975,723 | 8/1976 | Bowling et al. . | |
| 4,501,963 | 2/1985 | Perisic . | |
| 4,639,713 | 1/1987 | Kitagawa | 250/221 X |
| 4,944,116 | 7/1990 | Mewald | 49/27 |
| 4,953,608 | 9/1990 | Larsson . | |
| 5,025,847 | 6/1991 | Mueller | 160/270 |
| 5,139,074 | 8/1992 | Warner | 160/271 |
| 5,141,044 | 8/1992 | Hying et al. . | |
| 5,214,293 | 5/1993 | MacNeil | 250/561 |
| 5,216,246 | 6/1993 | Weldman et al. | 250/221 X |
| 5,228,492 | 7/1993 | Jou | 160/3 X |
| 5,271,448 | 12/1993 | Delgado | 160/265 |
| 5,299,617 | 4/1994 | Hying et al. | 160/271 |
| 5,335,749 | 8/1994 | Taguchi et al. | 180/274 |
| 5,353,859 | 10/1994 | Oltahfer et al. | 160/310 |
| 5,357,183 | 10/1994 | Lin | 318/468 |
| 5,420,430 | 5/1995 | Trett | 250/341 |
| 5,540,269 | 7/1996 | Plumer | 160/3 |
| 5,576,581 | 11/1996 | Ianuzzi et al. | 160/310 X |
| 5,632,317 | 5/1997 | Krupke et al. | 160/265 |
| 5,638,883 | 6/1997 | Schulte | 160/271 |

OTHER PUBLICATIONS

Overhead Door Jetroll, Form A–988 Oct. 1995, Copyright Overhead Door Corporation 1995, 14 pages.

Kelley Tufflex Beam, Form 20–332, Copyright Kelley Company, Inc. 1993.

*Primary Examiner*—Kenneth J. Dorner
*Assistant Examiner*—Bruce A. Lev

[57] ABSTRACT

An impact detection system for an industrial door, the system including two members that are releasably coupled to each other to move together with the door as it travels; disposed beyond the doorway opening is a radiation emitter and a radiation detector, preferably packaged together in a photoeye device, and emitting a beam of radiation; the first member carries a reflector that, when the two members are coupled, reflects the radiation back to the photoeye, and that is movable to a position wherein it does not reflect the radiation back to the photoeye in response to separation of the two members caused by the door being impacted, the change in state from 1) the radiation being reflected to the photoeye to 2) the radiation not being reflected to the photoeye thus serves as an indication that an impact on the door has occurred.

17 Claims, 9 Drawing Sheets

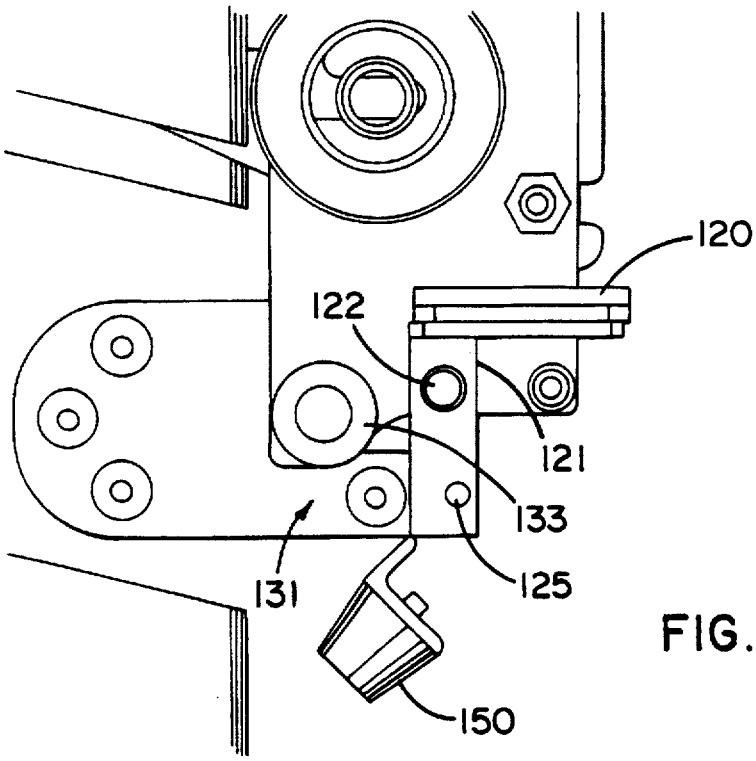
FIG. 14
FIG. 15
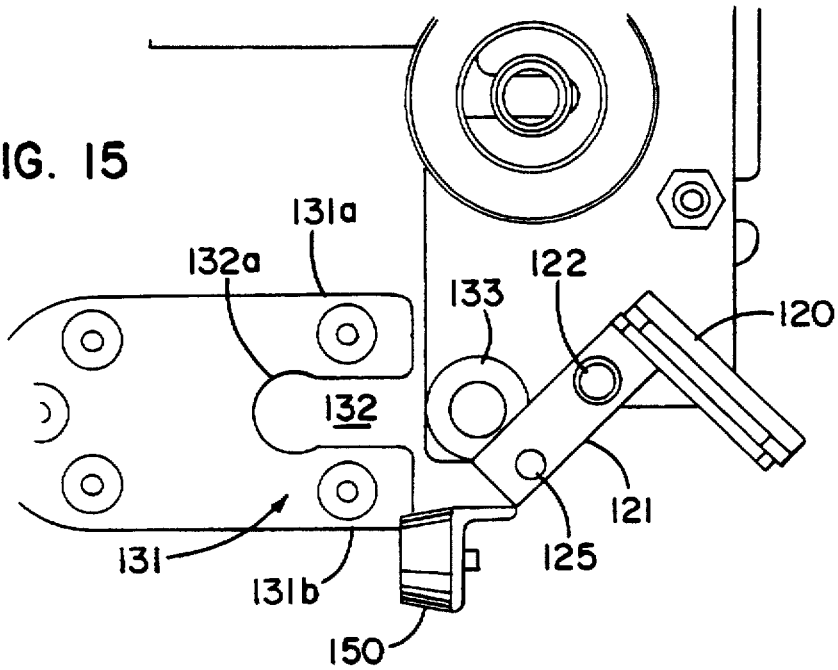

IMPACT DETECTION SYSTEM FOR INDUSTRIAL DOORS

FIELD OF THE INVENTION

The present invention is directed generally to industrial doors, and more particularly to a system for indicating when an industrial door has been impacted.

BACKGROUND OF THE INVENTION

Industrial doors are used in a wide variety of environments for blocking and unblocking doorways through which personnel and equipment may pass. Among the common types of industrial doors are sectional doors formed of a series of panels which are hinged together to form the door. Another form of industrial door is a roller door. Typically, roller doors comprise a fabric curtain that is wound onto and off of a roller typically disposed above the doorway opening to block and unblock the doorway. Another type of industrial door is a concertina door. A concertina door is also formed of a fabric and includes straps typically attached to the leading edge of the curtain. These straps are rolled onto and off of a roller disposed above the doorway opening for the purpose of moving the curtain between blocking and unblocking positions, with the curtain folding upon itself as it is raised. While such doors are typically vertically operated, they may also be mounted for horizontal operation.

All of these illustrative industrial doors, along with other examples of such doors, may be impacted during their travel. One such impact on a door occurs when the door encounters an obstacle. For example, as an industrial door moves from an open to a closed position, an obstacle in the doorway opening may be struck by the door as it lowers. In the case of sectional doors, comprised as they typically are of rigid panels, such encountering of an obstacle may either damage the door, the obstacle, or both. Similarly, most roller and concertina doors also include a rigid bar extending across the leading edge of the curtain, which is usually the bottom edge. Typically, the rigid bottom bar serves as an anchor for straps disposed at either end of the bar which assist in pulling the door toward the closed position. Bottom bars may also serve the function of preventing the curtain in the area of the bottom bar from billowing under wind or deferential pressure conditions. Contact between the relatively rigid bottom bar and an obstacle during travel of the door can also lead to damage. One means of eliminating or minimizing such damage is for a roller door to employ a soft bottom edge such as that disclosed in co-pending U.S. patent application Ser. No. 08/437,853 assigned to the assignee of the present invention. The soft bottom bar according to that patent application minimizes any damage by deflecting and conforming to the obstacle.

Regardless of the type of door or leading edge that may be involved in an impact between an industrial door and an obstacle, the resulting damage or injury will typically be minimized if the door either stops its travel or reverses its direction of travel at the time of impact. This is particularly true when the impact is caused by a lowering door encountering an obstacle. Because of this, most such industrial doors include some type of so-called "reversing edge." The reversing edge is typically employed at the leading edge of the door and includes some type of sensing mechanism or electronics for determining when an obstacle has been encountered. This, in turn, causes a mechanical action or a signal to be generated which, in turn, leads a motor or other driving mechanism to stop or reverse the travel of the door.

Since many of these devices are electronic, such doors may require wires to be run to or along the leading edge of the door. Moreover, such devices are subject to wear as they typically directly receive the impact being detected.

Industrial doors may also be subjected to impacts besides those occurring when the door encounters an obstacle. Impacts can also come from external sources, such as material handling equipment, running into the door. Given the high speed with which forktrucks typically travel (around 4 mph), such impacts are not uncommon. Since the vehicle or other object striking the door will be in or near the doorway when the impact occurs, it is also desirable for the door to stop or reverse its direction of travel for this type of impact as well.

SUMMARY OF THE INVENTION

The present invention is directed to an impact detection system that indicates when an industrial door has been subjected to an impact. While the preferred embodiment of the invention detects impacts at the leading edge of a vertically operated door, the detection system according to the invention may be adapted to detect an encounter between the door and an obstacle at other positions on the door besides the leading edge. Given that the detection system according to the invention plays an important safety function, an important object of the invention is providing a detection system that gives reliable and repeatable performance. In addition, it is an object of the invention to provide such an impact detection system that is simple to implement and simple in its operational details. Another object is to provide an impact detection system that is protected from the potentially harsh and active environment of an industrial door.

In accordance with these and other objects of the present invention, a novel impact detection system is provided. In its broadest sense, the impact detection system comprises two members that are releasably coupled to each other and that, when they are coupled, move together with the door as it travels. A first member preferably extends beyond the doorway opening, and is protected from the doorway environment. Also disposed beyond the doorway opening is a radiation emitter and a radiation detector, preferably packaged together in a photoeye device. The photoeye emits a beam of radiation, typically in the direction of travel of the door. The first member carries a reflector that, when the two members are coupled, reflects the radiation back to the photoeye. According to the invention, however, this reflector is also movable to a position wherein it does not reflect the radiation back to the photoeye in response to separation of the two members caused by the door being impacted. A releasable coupling between the first member and second member is designed to provide such separation when the door encounters an impact above a certain magnitude. The change in state from 1) the radiation being reflected to the photoeye to 2) the radiation not being reflected to the photoeye thus serves as an indication that an impact on the door has been detected.

According to the preferred embodiment of the invention, the obstacle detection system is adapted for use with a fabric roller door. The roller door includes enclosures on either side of the door which receive the lateral edges of the curtain. The photoeye is housed within such an enclosure, thus protecting the photoeye and its radiation beam from the environment of the door. Further, the first of the two releasably coupled members, and the reflector that is carried with the first of the members, are also received within this enclosure. The second of the two members, according to one embodiment, is a cable which extends across the width of the door in a preferably stretched condition. In an alternative embodiment, the second member is a plate fixed to a lateral edge of the door. Impact on the door, such as by contact between the door and an obstacle, causes release of the releasable coupling between the first member and the second member. This in turn causes the reflector to move between its two positions. The first of the two members also preferably includes a bias member that biases the reflector toward its non-reflecting position in response to separation of the releasable coupling between the two members.

BRIEF DESCRIPTION OF THE DRAWINGS

FIG. 14 is a front elevation of the impact detection system according to the preferred embodiment of the invention, and shown in the coupled state;

FIG. 15 is a front elevation of the system of FIG. 14, shown in a separated state;

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents as are included within the scope and spirit of the invention as defined by the appended claims.

Figure 1:
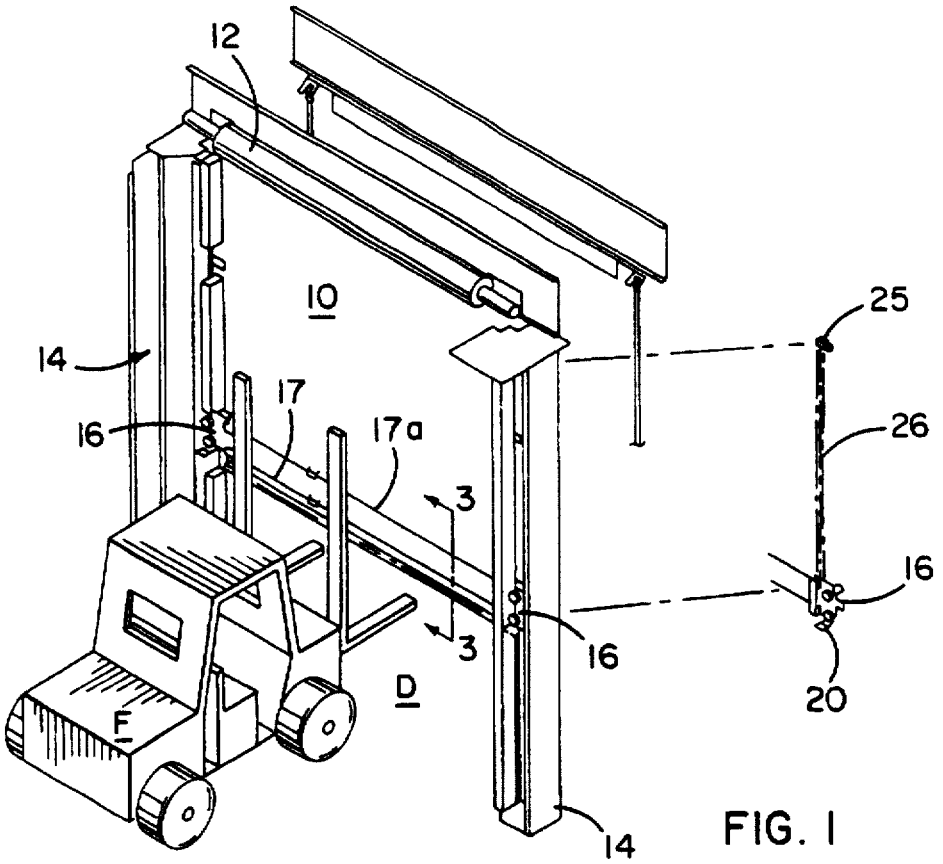
FIG. 1 is an isometric view showing a door upon which the impact detection system according to the invention could be used, along with an exploded view of a portion of the impact detection system.

An illustrative industrial door with which the impact detection system of the present invention could be used is shown in FIG. 1. The door is a roller door including a curtain 10 which is wound onto and off of a roller 12 disposed above the doorway D to respectively unblock and block the doorway. Guide members in the form of sideframes 14 are disposed on either side of the doorway for receiving the lateral edges of the curtain 12 and guiding it in a plane during travel, and for adding stability to the structure.

The sideframes 14 also receive and guide first members, illustratively in the form of trolleys 16, which are releasably coupled to the leading edge of the curtain 12, and which form a part of the present invention. In this present embodiment, this coupling is achieved by virtue of a second member, illustratively in the form of a cable 17, being coupled to the leading edge of the curtain 12. In this embodiment, the cable 17 is coupled to the curtain by virtue of being received within a pocket of material sewn or otherwise attached to the curtain fabric (see FIG. 4), not shown in FIG. 1 for clarity. The second member or cable 17 is then in turn releasably coupled to the trolley 16. It will be noted that the illustrated door includes a second cable 17*a*, which is included to add stability to the leading edge of the door, but which does not form a part of the present impact detection system. In an alternative embodiment to be presented below, the trolley 16 is coupled to the curtain by virtue of the trolley 16 being releasably coupled to a second member in the form of a plate fixed to the curtain lateral edge. While the first and second members in the embodiments disclosed herein are associated with the leading edge of the curtain, the invention is not so limited. Rather, the impact detection system could be deployed anywhere along the height of the door.

The door also includes a motor (not shown) or other driving means for driving the roller to which the curtain is attached. While some roller doors are powered open and allowed to fall closed by means of gravity, the door illustrated in FIG. 1 is intended to be powered closed. For that purpose, roller 12 may include a drum (not shown) affixed thereto, and disposed beyond the width of the curtain. A strap is wound on the roller in the opposite sense to the direction the curtain is wound on the roller. Thus as the curtain unwinds from the roller, the strap winds onto the drum. The strap passes around at least one pulley, disposed adjacent the bottom of the doorway, and the other end of the strap is attached at or near the leading edge of the curtain (in this case, it is attached to the trolley 16 which is releasably coupled to the leading edge of the curtain), thus pulling down on the curtain as it unwinds from the roller. Various combinations of pulleys, springs and weights may act on the belt to ensure that a proper amount of tension is maintained on the belt and the curtain during travel.

Figure 2:
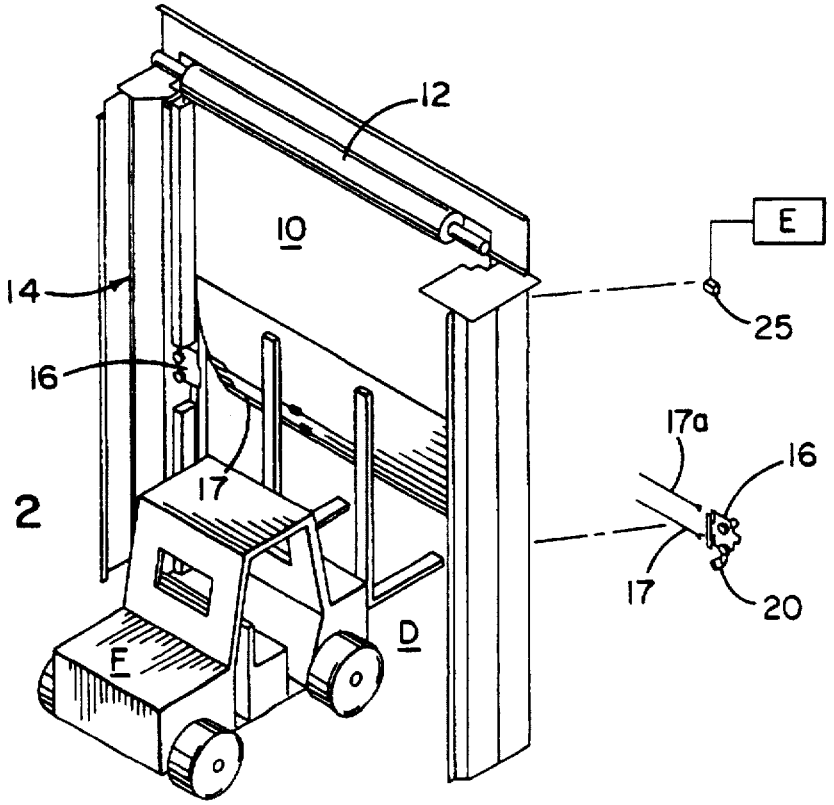
FIG. 2 is an isometric view of the door of FIG. 1, shown after an impact by a fork truck, and showing the response of a portion of the impact detection system.

FIG. 1 also shows a situation in which an impact on the door may occur, which impact is intended to be detected by the system of the invention. In this case, a forktruck F is about to strike the curtain during its travel between doorway blocking and unblocking positions. The result of this impact is seen in FIG. 2. The forktruck has struck the curtain, causing the releasable coupling between the second member (cable 17) and the trolley 16 to separate the second member 17, and thus the curtain to which it is coupled, from the trolley 16. According to the invention, it is this separation of the second member or cable 17 from the trolley 16 that triggers the novel impact detection system. Since the cable 17 is coupled to the curtain 12, such separation indicates that the curtain has been impacted. As discussed above, the curtain 12 may undergo other types of impact, such as encountering an obstacle in the doorway D as it moves toward the closed position. The releasable coupling forming an aspect of the present invention may advantageously also provide for separation of the curtain 12 and the trolley 16 for these impacts as well.

Since the separation of the first member or trolley 16 from the second member or cable 17 (through the releasable coupling joining them) is intended to trigger the detection system of the invention, the system also includes structure that is responsive to this separation. Toward that end, this embodiment of the invention includes a subsystem for detecting separation of the first member and the second member. That subsystem, which is shown exploded away from the door in FIG. 1, and which is also shown in FIG. 2 in a different state, includes a reflector 20 carried on the first member or trolley 16, a radiation emitter, and a radiation detector, both of which are mounted adjacent the doorway D, preferably in the sideframe. In the present embodiment, the emitter and the detector are combined in a "photoeye" 25. For the purposes of this specification a "photoeye" will refer to a combined electromagnetic radiation emitter and a photoeye-type detector. When the second member or cable 17 is coupled to the first member or trolley 16, the reflector 20 is in a first position (FIG. 1), which in the present representative example is a position wherein radiation 26 emitted by the photoeye 25 is reflected back to the photoeye 25 (for example, the reflector is perpendicular to the line of the emitted radiation from the photoeye). When the cable 17 is separated from the trolley 16, however (as in FIG. 2), the reflector 20 is adapted to move to a second position, which in this exemplary embodiment is a position wherein the radiation 26 emitted from the photoeye 25 is not reflected back to the photoeye 25. It will be appreciated, however, that the first (reflecting) and second (non-reflecting) positions of the reflector 20 could be reversed in alternative embodiments of the invention. The photoeye typically outputs one signal when it is detecting the emitted radiation 26, and a different signal when it is not detecting the emitted radiation. The change in state of the photoeye output from the one signal to the different signal thus indicates that the second member or cable 17 has separated from the first member or trolley 16, thus in turn indicating that the curtain 12 has been impacted. This output may be illustratively coupled to electronics represented by functional block E, which electronics may be coupled to the motor, and that are responsive to this change in state to stop or reverse the direction of the motor (or both).

Figure 4:
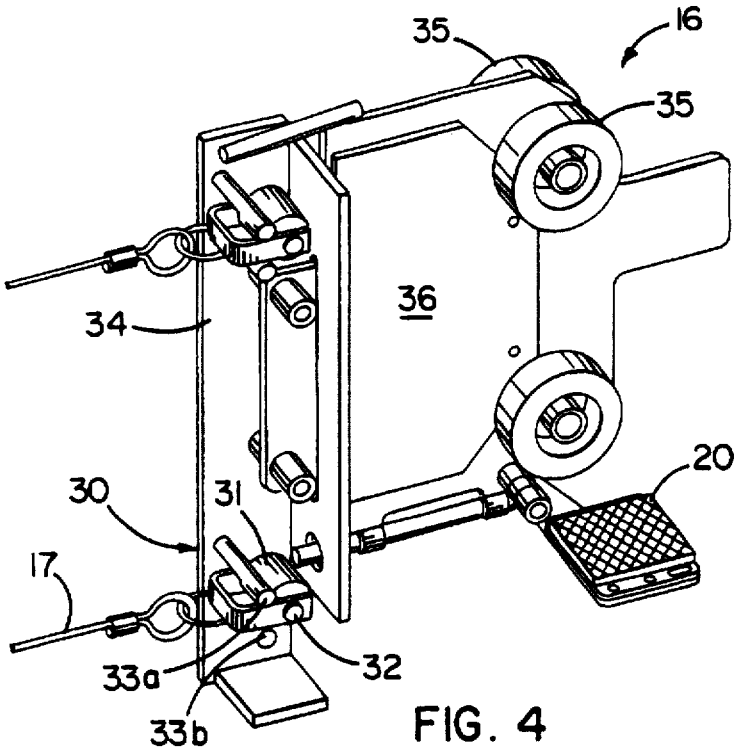
FIG. 4 is an isometric view of a releasable coupling forming an aspect of the present invention.
Figure 5:
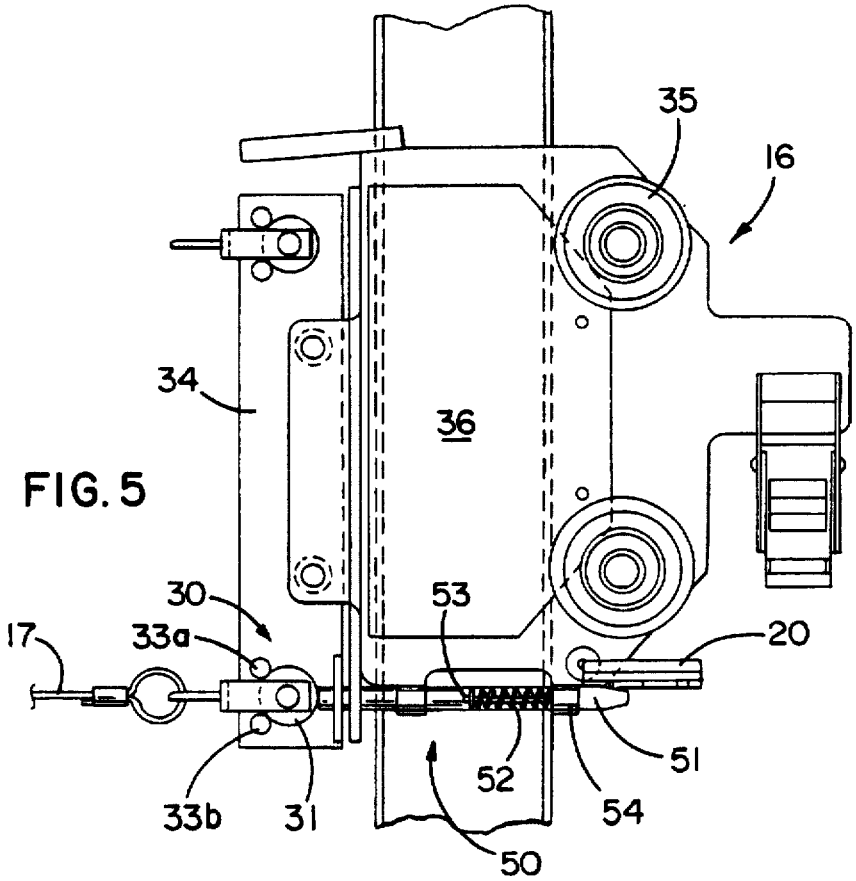
FIG. 5 is a front elevation of the releasable coupling shown in FIG. 4.

The general structure and operation of the impact detection system having been described, the releasable coupling between the first member 16 and the second member 17, and the means by which the operation of the releasable coupling causes the reflector 20 to move between its first and second positions will now be described in greater detail with reference to FIGS. 4–10. FIGS. 4 and 5 are isometric and elevational views of the trolley 16 including the reflector 20, and the releasable coupling 30 between the trolley 16 and the second member or cable 17. The releasable coupling in the present embodiment is in the form of a first member portion, illustratively forming a part of the first member or trolley 16, and a second member portion illustratively forming a part of the second member or cable 17. The second member portion is in the form of a deformable roller 31 attached to the cable 17 by an axle member 32. The first member portion is in the form of a cage comprising two axles 33*a* and 33*b*, and two flatbar members 34 (one of which has been removed for clarity) forming a part of the trolley16. The cage is designed such that the deformable roller 31 is normally received within the cage. That is, the axles 33*a,b* are separated by a distance smaller than the diameter of the roller 31. When a force tending to separate the cable 17 and the trolley 16 is exerted on the cable, however, the deformable roller 31 is intended to deform and pull past the axles 33*a* and 33*b* forming the cage.

The source of such a force tending to separate the cable 17 from the trolley 16 is illustratively an impact on the door. As shown in FIG. 1, the cable 17 is coupled to a trolley 16 at each end of the cable, thus stretching the cable between the trolleys 16. For an impact on the door in the vicinity of the cable, the impact force will either be directly applied to the cable 17, or be indirectly applied through the fabric of the curtain 12. In either event, an impact force above a certain magnitude will cause the cable 17 to deform in the area of the impact. For forces below the predetermined magnitude (such as might be applied to the door by wind or pressure differentials) separation of the first member and the second member is not desired.

For an impact into the plane of the doorway D (e.g. impact by a forktruck) the cable 17 will bow inward. For an impact in the plane of the doorway (e.g. the downwardly traveling curtain encountering an obstacle), the cable 17 will bow upward. At the same time, the trolley 16 is restrained from moving in a direction toward the center of the curtain 12. To provide such restraint from movement toward the center of the curtain, trolley 16 illustratively includes rollers 35 disposed on either side of a body 36. These rollers, in turn, engage projections 38 on the sideframe 14, such projections being labeled in the top section view of FIG. 10. The engagement between the rollers 35 and the projection 38 prevents the trolley from moving toward the center of the curtain even when the cable 17 is deformed as described above by an impact on the curtain 12. Accordingly, the bowing of the cable 17, combined with the restraint of the trolley 16 exerts a force on the cable tending to separate the cable from the trolley.

Figure 6:
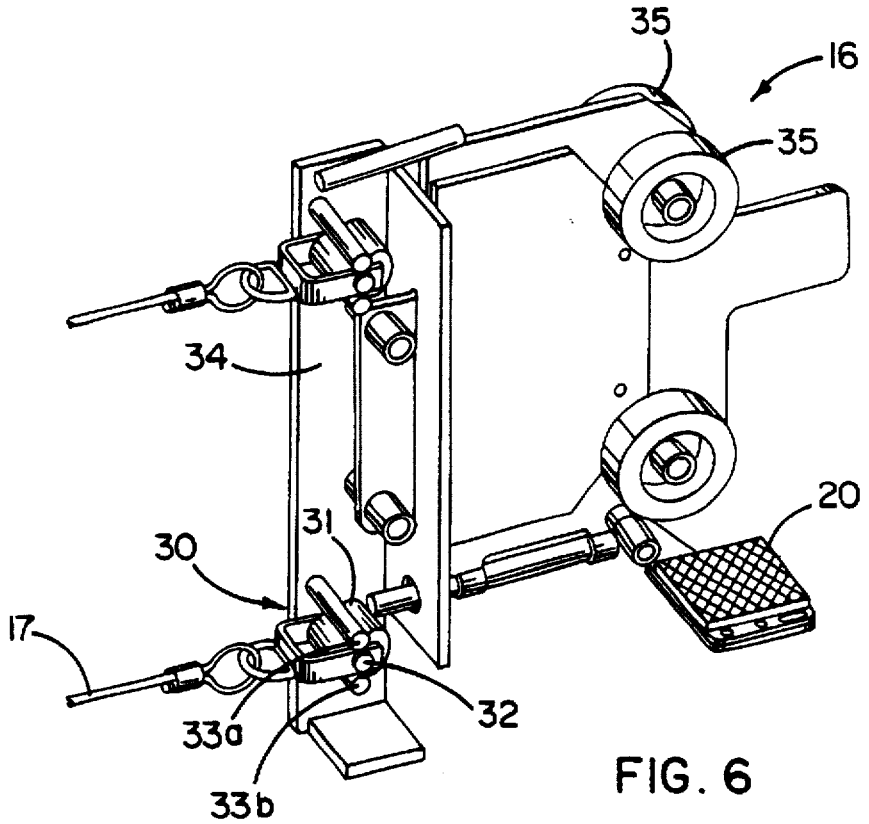
FIG. 6 is the releasable coupling of FIG. 4, shown in the midst of separation.

In response to such a force the deformable roller 31 of the releasable coupling of the invention deforms and releases from the cage assembly on the trolley. This deformation and release of the roller 31 from the cage is shown in the progressive operational views of FIGS. 4–9. FIGS. 4, 6, and 8 being isometric views and FIGS. 5, 7, and 9 being the corresponding elevations.

The releasable coupling according to this embodiment thus provides coupling of the trolley 16 and cable 17 for unimpeded operation of the door, and also provides for separation of the cable 17 and trolley 16 for impacts on the door above a certain magnitude. The magnitude of impact that will cause such separation may be modified in a variety of ways. For example, by changing the composition of the cable 17, its resiliency may be increased or decreased, a decreased resiliency meaning that the cable 17 will deform less for the same impact, thus exerting a greater separating force on the cable, and causing separation of the cable and trolley for an impact on the door of a smaller magnitude. Alternatively, the amount by which the cable 17 is stretched could be modified by changing its length. Further still, the composition of the deformable roller 31 could also be modified, a less deformable material giving a greater resistance to separation for the same impact force. Other examples of modifications that would change the magnitude of impact required to separate the cable and the trolley for this releasable coupling will be apparent to one of skill in the art.

It should be noted that the releasable coupling according to this embodiment of the invention provides for release of the cable and trolley for forces exerted both into and in the plane of the doorway. Modifications to limit the separation for only one type of these forces could, however, be made.

Further, although this embodiment shows an impact detection system for use with a soft leading edge of the door (cable 17), the invention also encompasses other types of bottom bars. For example, a conventional rigid bottom bar could form the "second member" of this invention. So long as such a bar were releasably coupled to the first member such that impact on the bar above a predetermined magnitude caused the bar to release from the first member, it would fall within this aspect of the invention. In the case of a rigid bottom bar, the first member would not necessarily have to be restrained against movement toward the center of the door. It only would need to be restrained to the extent necessary to provide separation from the bottom bar or second member for an impact force above the predetermined magnitude.

Figure 7:
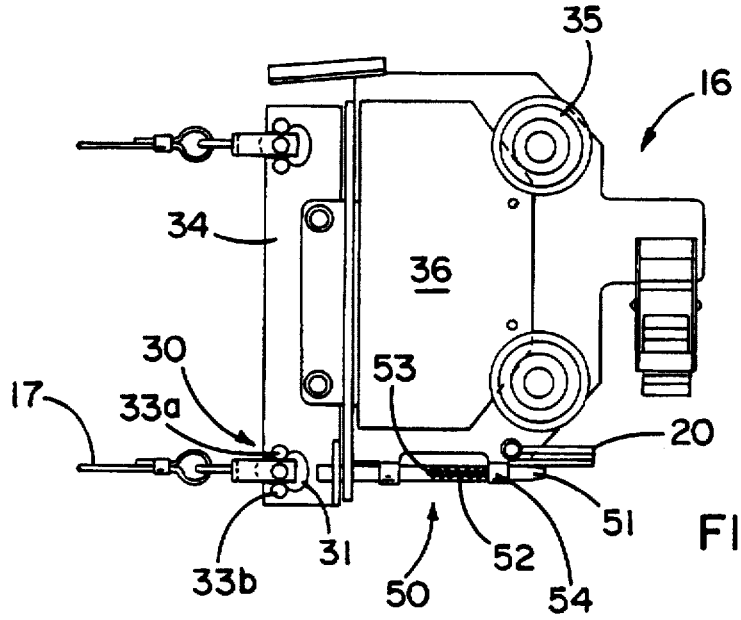
FIG. 7 is the releasable coupling of FIG. 5, shown in the midst of separation.
Figure 8:
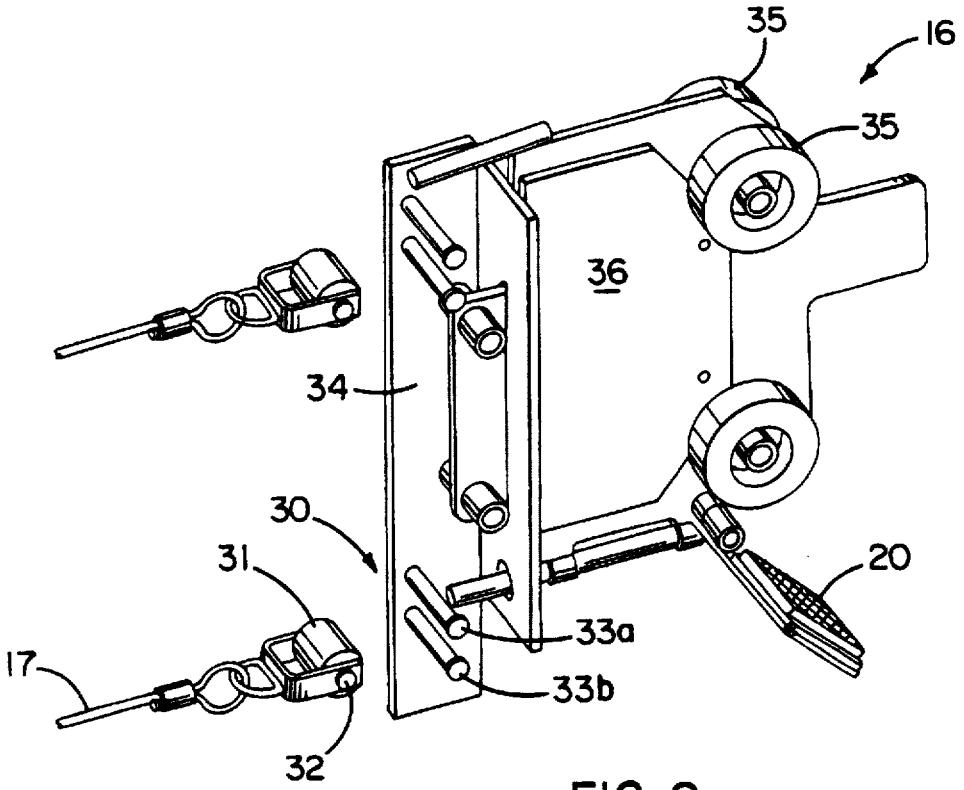
FIG. 8 is an isometric view of the releasable coupling of FIG. 4, shown separated.
Figure 9:
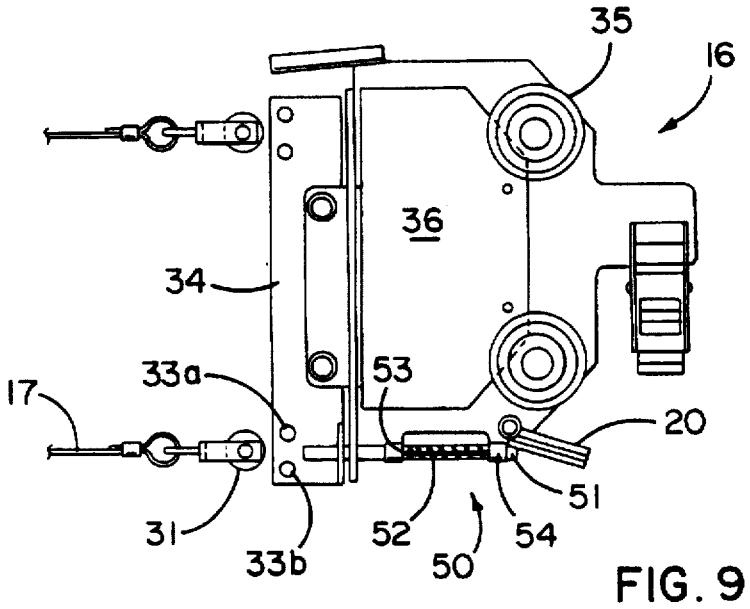
FIG. 9 is a front elevation of the releasable coupling of FIG. 4, shown separated.
Figure 10:
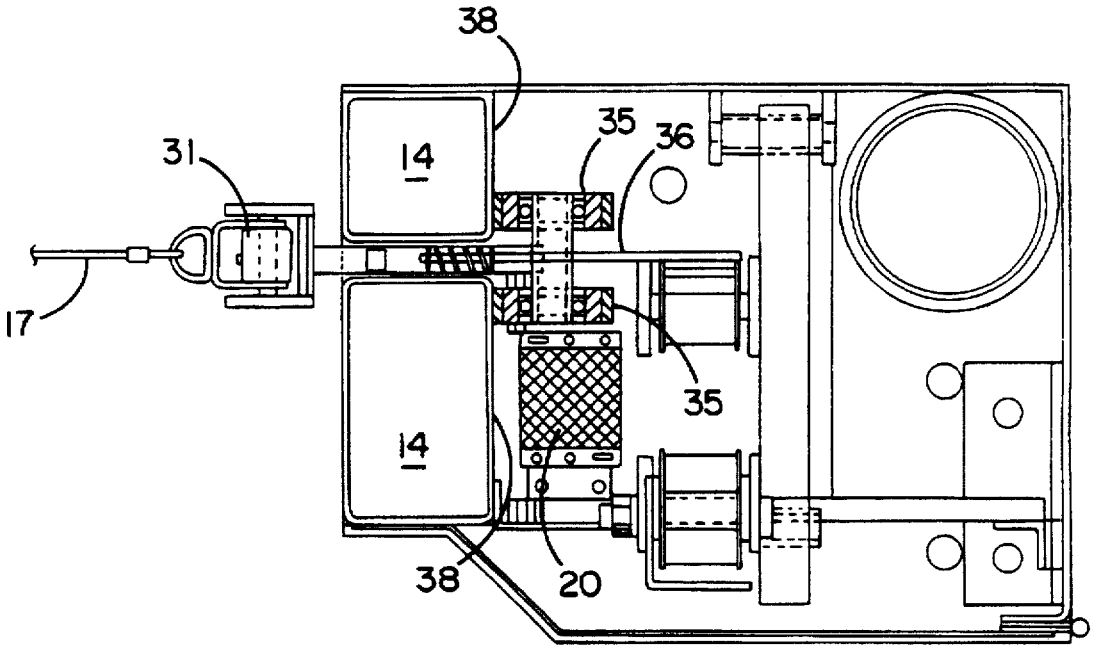
FIG. 10 is a top section showing a portion of the impact detection system of the invention, as well as a sideframe with which it is associated.

In order for the impact-induced separation of the first member 16 and second member 17 to be indicative of a door impact, the reflector 20 responds to this separation by moving between its first and second positions, as best illustrated in FIGS. 5, 7 and 9. The reflector 20 in this embodiment is pivotally mounted to the trolley 16, such that it can rotate between its two positions. According to the invention, the reflector 20 is normally held in the first position, but moves to the second position in response to impact on the curtain. In the present embodiment, this responsiveness is provided by a plunger mechanism 50, which is in operative engagement with the releasable coupling 30. The plunger mechanism includes a plunger 51 carried by the trolley 16 and movable between an engaged position where it maintains the reflector 20 in the first position (FIG. 5) and a disengaged position wherein it allows the reflector 20 to move to the second position (FIG. 7). Whether the plunger is in the engaged position or the disengaged position is controlled by whether the releasable coupling 30 is coupled or uncoupled (i.e. whether or not the first member and second member are coupled). In the present embodiment, the plunger 51 is biased toward the disengaged position by means of a bias spring 52. With the roller 31 of the coupling 30 in the coupled position, the bias spring 52 is compressed between a pin 53 on the plunger 51, and a bushing 54 through which the plunger passes. However, when the curtain is impacted, and the roller 31 separates from the axes 33*a*, 33*b*, nothing prevents the plunger 51 from moving to the disengaged position of FIG. 10. The reflector now being unsupported, it falls by gravity to the second position. Since it is an impact on the curtain that begins the chain of events leading to the reflector moving to the second position, and thus not reflecting the radiation back to the photoeye 25 (FIG. 2), the change in state of the photoeye that results serves as an indication that impact to the curtain has occurred.

As will be appreciated by one of skill in the art, modifications could be made to the structure just described for making movement of the reflector 20 between its first and second positions responsive to separation of the first member 16 and second member 17. For example, the bias spring could be a torsion spring directly coupled to a pivotally mounted reflector and tending to move it toward the second position. Alternatively, the bias could be provided by the gravitational force alone tending to rotate the reflector toward the second position. As a still further alternative, the plunger structure could be replaced by an equivalent structure that would otherwise provide responsive movement between the first and second positions for the reflector 20.

Figure 3:
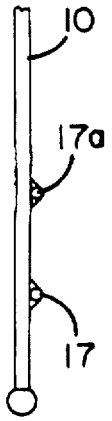
FIG. 3 is a cross section of a portion of the door shown in FIG. 1.
Figure 11:
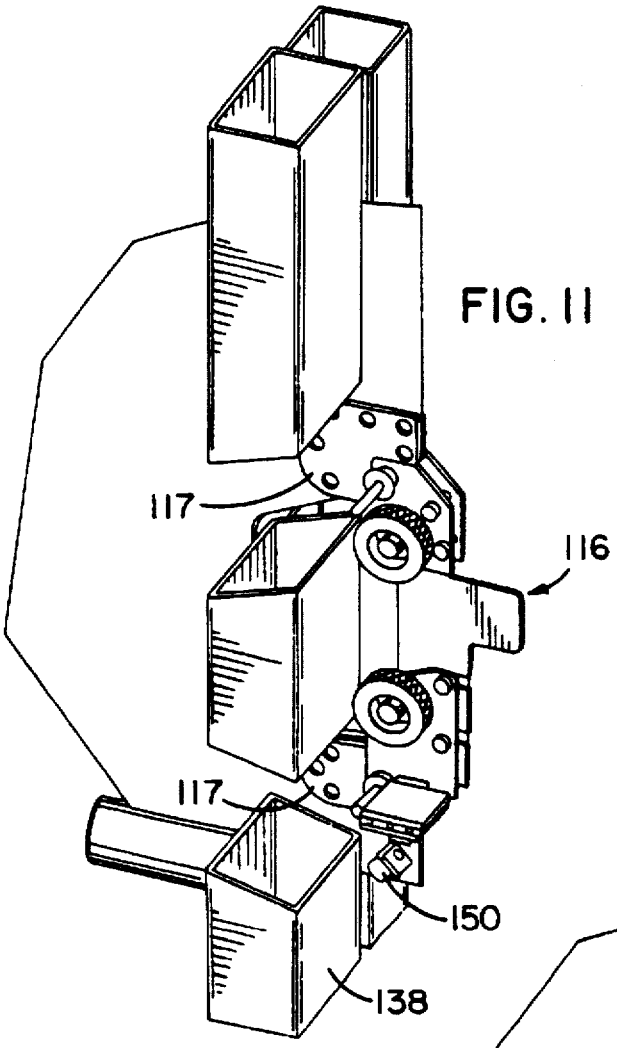
FIG. 11 is an isometric view of a roller door upon which an impact detection system according to the invention could be used, and also shows a preferred embodiment of that impact detection system.
Figure 12:
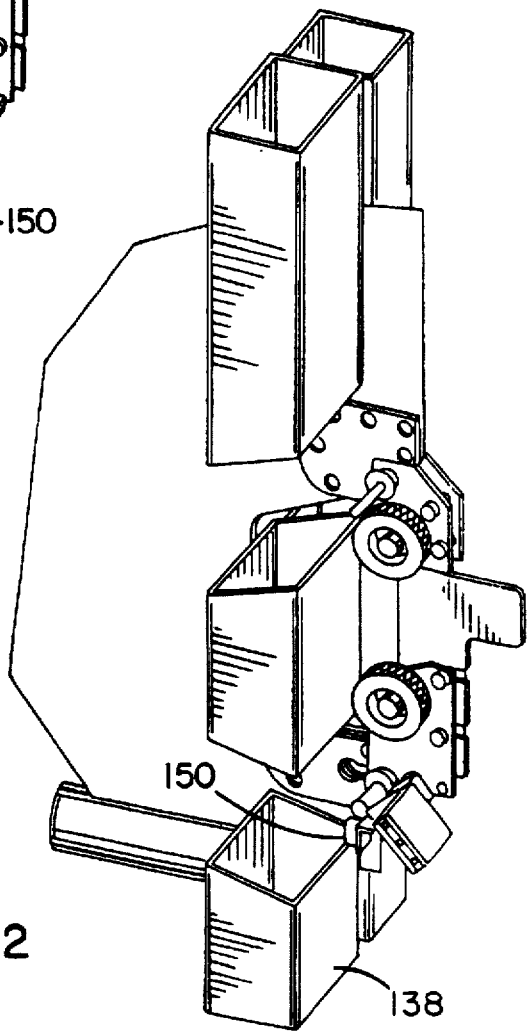
FIG. 12 is a view of the door of FIG. 11, shown broken away, and showing a different state for a portion of the impact detection system.
Figure 13:
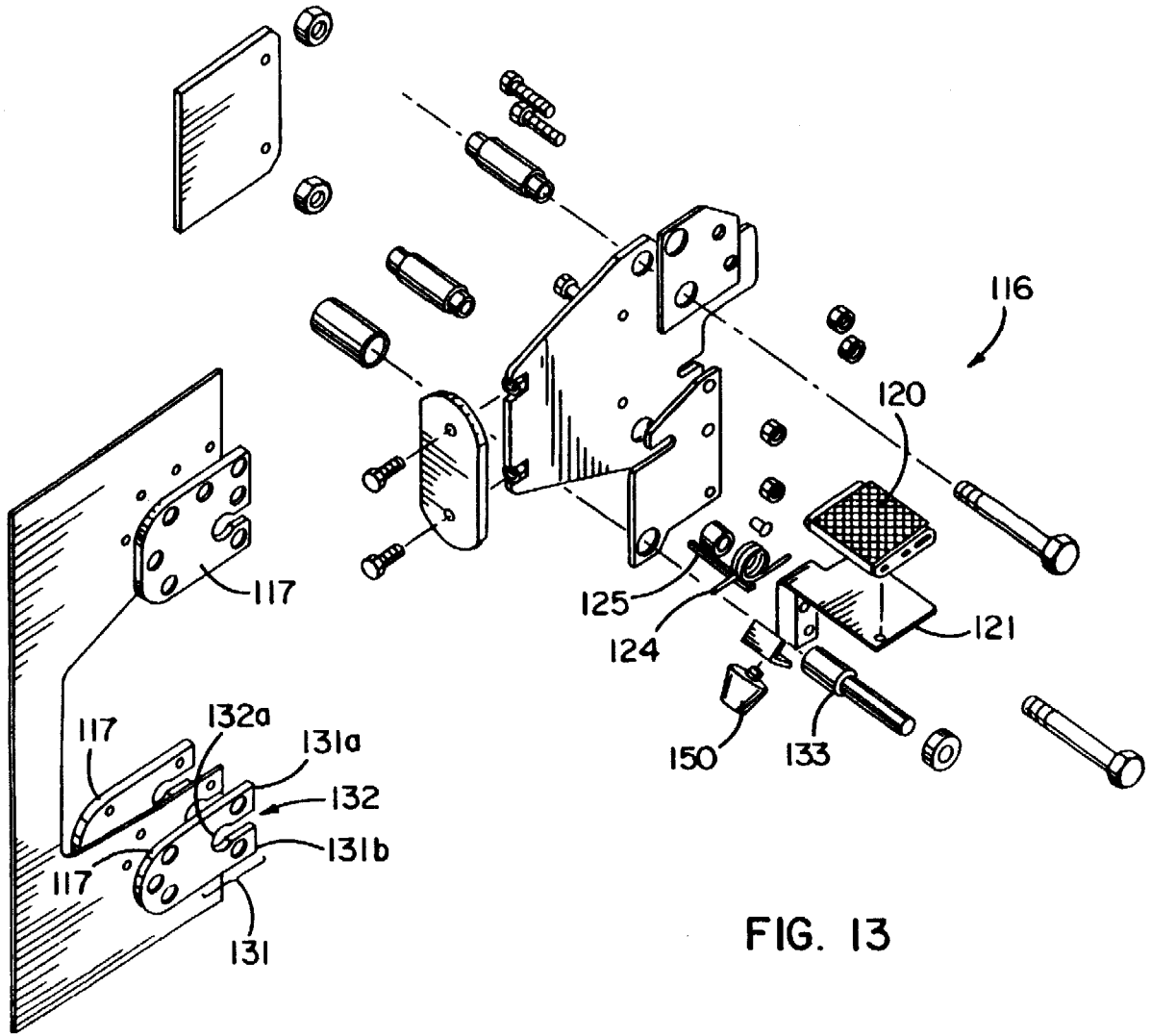
FIG. 13 is an exploded view of the trolley forming an aspect of the preferred embodiment of the invention.

An alternative embodiment of the impact detection system according to the present invention, and the embodiment presently perceived as the best mode for carrying out the invention, is seen in an isometric view in FIGS. 11 and 12. In this embodiment, the first member is again in the form of a trolley 116. The second member, however, is not a cable, but rather a plate of material 117 attached to the lateral edge of the curtain. The plate, illustratively fixed to the curtain by rivets or screws, is formed of NYLON 6/6. At present we are also investigating possible use of NYLON 6/6 with a moly disulfide additive, and can best be seen in the exploded view of FIG. 13, showing the trolley 116 and the plates 117. It should be noted that in this embodiment, the second member 117 is coupled to the curtain by being fixed directly to it. In the previous embodiment, the coupling was by virtue of the cable 17 being carried in a pocket on the curtain itself (see the section view of FIG. 3). The term "coupling" is intended to encompass both situations.

The releasable coupling between the trolley 116 and the plate 117 again comprises a first member portion and a second member portion, each illustratively forming a part of the first member and second member, respectively. As seen in FIG. 13, the first member portion 133 is in the form of a rigid roller forming a part of the trolley 116 and preferably NYLON 6/6. At present, we are also investigating possible use of NYLON 6/6 with a moly disulfide additive for roller 133. The roller has a narrow end and a wider end. The roller 133 is disposed on the trolley such that the wider end is received within the second member portion 131 to make the releasable coupling between the trolley 116 and the plate 117. The narrower end is provided to allow the roller 133 to move to a position wherein re-attachment of the releasable coupling can be achieved more easily following an impact on the door. The second member portion 131 is integral with the plate 117, and comprises the end of the plate 117 which includes two arms 131*a* and *b* which define a slot 132. The end of the slot includes a detent 132*a*, illustratively having a circular shape to correspond to the circular cross-sectional shape of the wider end of the roller 133 of the first member portion.

For an impact on the door, as described in more detail above, a separation force is exerted on releasable coupling 130, tending to separate the second member portion 131 and the roller 133. This action is perhaps most clearly seen in reference to FIGS. 14 and 15, showing the releasable coupling coupled and separated, respectively. As the second member 117 begins moving to the left in the sense of FIG. 14, the roller 133 moves out of the detent and begins to force the arms 131*a* and *b* to separate. Continued leftward movement of the second member portion 131 allows the roller 133 to completely separate therefrom.

Figure 16:
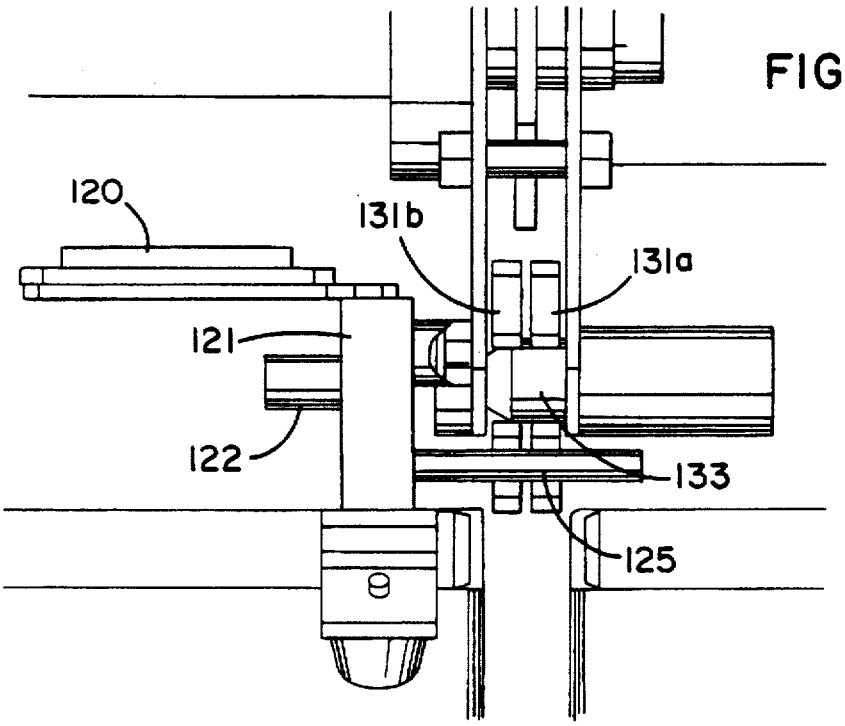
FIG. 16 is a side elevation of the system shown in FIG. 14, in a coupled state.

According to the invention, this separation of the trolley 116 from the plate 117, causes the reflector 120 to move between its first and second positions (FIGS. 14 and 15, respectively). In this embodiment, the reflector 120 is mounted on a bracket 121, and the assembly is pivotally mounted about a pivot pin 122. The bracket and thus the reflector is biased towards its second position (FIG. 15) by means of a torsion spring 124 associated with the pivot pin 122, and seen most clearly in the exploded view of FIG. 13. To control movement of the bracket and reflector 120 between its two positions, a post 125 is carried on the bracket 121. The post 125 (seen more clearly in the side elevation of FIG. 16), is disposed such that it engages an end of the second member portion 131 when the releasable coupling between the trolley 116 and the plate 117 is coupled. Because of the position of the post 125 on the bracket 121, this engagement positions the reflector in its first position (FIGS. 14 and 16). Upon an impact-induced separation of the plate 117 and the trolley 116 (FIG. 15), the post 125 is no longer engaged with the end of the second member portion 131, and the reflector 120 and bracket 121 move to the second position under the influence of gravity as well as that of the biasing torsion spring 124. Advantageously, and to prevent the trolley 116 from falling upon separation from the plate 117 and thus the curtain, the bracket 121 may include a stopper 150 at an end thereof The stopper is disposed so that it engages a projection 138 on the sideframe. The frictional engagement between the preferably rubber stopper 150 and the projection 138 stops or at least significantly slows the trolley 116 from falling.

As in the previous embodiment, the force required to separate the first member 116 from the second member 117 may be modified in a variety of ways. The ability to modify the force of predetermined magnitude that must be applied to the curtain before breakaway will occur is advantageous in that the door may be modified for operation in a variety of environments. For extreme high wind situations, for example, it may be desirable to set the force of predetermined magnitude high to prevent nuisance breakaways due to wind, but to still allow breakaway for other undesirable impacts. In this embodiment, the amount of force required to separate the releasable coupling could be modified by forming the plate 117 of stiffer material, making it more difficult to push the arms 131*a,b* apart. Alternatively, to lessen the separation force required, the roller 133 could be formed of a compressible and deformable material as opposed to the NYLON 6/6 material of which it is presently formed. Other modifications, such as adjusting the lateral tension under which the curtain is held by connection of the plates to the trolleys, will be apparent to one of skill in the art.

Figure 17:
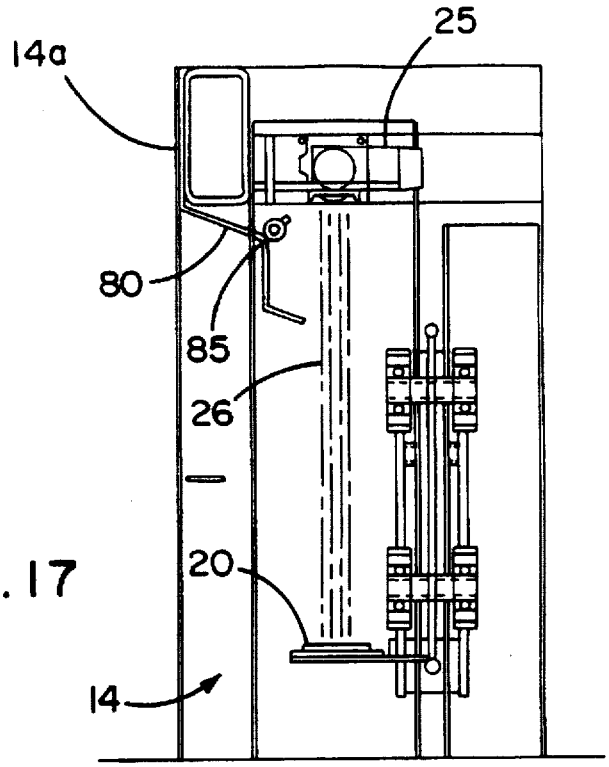
FIG. 17 is an elevation of the sideframe of the door with which the impact detection system according to the invention may be associated, and showing an additional advantageous feature of the invention, with the sideframe door closed.
Figure 18:
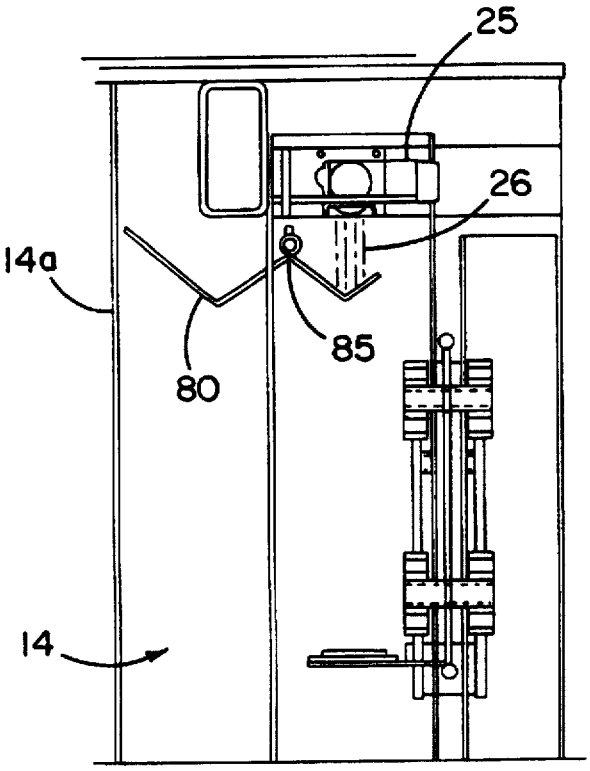
FIG. 18 shows the structure of FIG. 17, but with the sideframe door open.

The impact detection system of the present invention may also be advantageously used to enhance safety in the doorway area by preventing operation of the door when doors associated with the sideframe are open. Sideframes 14 are typically provided with doors 14*a* (shown open in the left side of FIG. 1) so that access can be gained to the interior for the purpose of maintaining and servicing the hardware, or to reassemble the door following breakaway. Given the fact that there are typically moving parts in the sideframe (counterweights, pull-down belts, pulleys, springs, etc.) operation of the door with the sideframes open could be hazardous. This can be avoided, according to an aspect of the present invention, by including a blocking member on the sideframe that causes a change in state of the photoeye when the door moves from the closed to the open position. Provided that the change in state of the photoeye caused by such movement of the blocking member upon the sideframe door opening is the same as that which causes the door to stop upon impact, the door would be prevented from operating with the sideframe door open. In the present embodiment, the blocking member carried on the sideframe is in the form of a tab 80, as seen most clearly in FIGS. 17 and 18. This tab 80 is disposed on the sideframe structure, and is pivotally attached thereto by means of a pivot pin 85. The tab 80 is movable between a first position (FIG. 17) wherein it does not block the radiation 26 emitted by the photoeye, and a second position (FIG. 18) wherein it does block the radiation 26. The presence or absence of the closed sideframe door 14*a* determines whether the tab 80 is in the first position or the second position. Accordingly, if the impact detection system is operated in a mode in which the roller door stops when the emitted radiation is not reflected back to the photoeye, the opening of the sideframe door would prevent operation of the door (or stop the door if it was in travel), since opening the sideframe door causes the tab 80 to move to its second position. If, on the other hand, the impact detection system is in a mode where the door stops for the emitted radiation being reflected back to the photoeye, the tab 80 could carry a reflector on the face facing the photoeye. This easily implemented feature prevents the potentially dire consequences of door operation with the sideframe open.

There has thus been disclosed a novel impact detection system for industrial doors. The system takes advantage of the fact that the door preferably breaks away for impact on the door. The system detects this breakaway, thus eliminating any need for the detection system to directly receive the impact, as in previous systems. Moreover, since the detection system may be mounted adjacent the door in the sideframes, it is protected from the harsh door environment. Enhanced safety and reliability are the result.

What is claimed is:

1. An impact detection system for use on an industrial door movable relative to a doorway between blocking and unblocking positions, the detection system comprising:

a first member adapted to be disposed adjacent the door, and capable of movement therewith;

a second member which can be coupled to the door for travel therewith;

a releasable coupling between the first member and the second member, the releasable coupling providing coupling of the first and second members such that they travel together with the door during unimpeded door operation, and providing separation of the first and second members for an impact on the door above a predetermined magnitude;

a reflector coupled to the first member and movable from a first position to a second position in response to separation of the first member and the second member, and a radiation emitter which emits a radiation beam, and a radiation detector, which are disposable adjacent the doorway such that the radiation beam is reflected back to the detector with the reflector in one of the first and second positions, and such that the radiation beam is reflected away from the detector with the reflector in the other of said first and second positions.

2. The detection system of claim 1, wherein the detector is in a first state when the radiation beam is reflected back to the detector, and is in a second state when the radiation is reflected away from the detector, a change in state from the first state to the second state indicating an impact on the door above the predetermined magnitude.

3. The impact detection system of claim 1, wherein the releasable coupling comprises a first member portion which forms a part of the first member, and a second member portion which forms a part of the second member.

4. An impact detection system for use on a roller door including a curtain movable relative to a doorway between blocking and unblocking positions, the door including enclosures disposed adjacent lateral edges of the doorway for receiving and guiding the lateral edges of the curtain in a vertical plane, the detection system comprising:

a first member movable within an enclosure;

a second member which can be coupled to the curtain for travel therewith, a releasable coupling between the first member and the second member, the releasable coupling providing coupling of the first and second members such that they travel together with the curtain during unimpeded operation, and providing separation of the first and second members for an impact on the curtain above a predetermined magnitude;

a reflector coupled to the first member and movable from a first position to a second position in response to separation of the first member and the second member; and a radiation emitter which emits a radiation beam, and a radiation detector, both disposed adjacent the doorway and mountable in the enclosure such that the radiation beam is reflected back to the detector with the reflector in one of the first and second positions, and such that the radiation beam is reflected away from the detector with the reflector in the other of said first and second positions.

5. The detection system of claim 4, wherein the detector is in a first state when the radiation beam is reflected back to the detector, and is in a second state when the radiation is reflected away from the detector, a change in state from the first state to the second state indicating an impact on the door above the predetermined magnitude.

6. The impact detection system of claim 4, wherein the releasable coupling comprises a first member portion which forms a part of the first member, and a second member portion which forms a part of the second member.

7. The impact detection system of claim 4, wherein the first member is a trolley including wheels.

8. The impact detection system of claim 7, wherein the second member is a cable capable of being coupled to the curtain.

9. The impact detection system of claim 7, wherein the second member is a plate fixable to the curtain.

10. The impact detection system of claim 4, wherein the reflector is pivotally coupled to the first member, for movement between the first position and the second position.

11. The impact detection system of claim 10, and including a biasing member for biasing the reflector to one of said first and second positions.

12. The impact detection system of claim 4, and including a biasing member for biasing the reflector to one of said first and second positions.

13. An impact detection system for use on a roller door including a curtain having a center and movable relative to a doorway between blocking and unblocking positions, the door including sideframe enclosures disposed adjacent lateral edges of the doorway for receiving and guiding the lateral edges of the curtain in a vertical plane, the sideframes including projections and sideframe doors movable between open and closed positions, the detection system comprising:

a first member movable within a sideframe enclosure;

a second member which can be coupled to the curtain for travel therewith;

a releasable coupling between the first member and the second member, the releasable coupling providing coupling of the first and second members such that they travel together with the curtain during unimpeded operation, and providing separation of the first and second members for an impact on the curtain above a predetermined magnitude;

a reflector coupled to the first member and movable from a first position to a second position in response to separation of the first member and the second member; and a radiation emitter which emits a radiation beam, and a radiation detector, both disposed adjacent the doorway and mountable in the sideframe enclosure such that the radiation beam is reflected back to the detector with the reflector in one of the first and second positions, and such that the radiation beam is reflected away from the detector with the reflector in the other of said first and second positions.

14. The impact detection system of claim 13, wherein the first member is a trolley including wheels engageable on sideframe projections for preventing the trolley from moving toward the center of the curtain.

15. The impact detection system of claim 13, wherein the detector is in a first state when the radiation beam is reflected back to the detector, and is in a second state when the radiation is reflected away from the detector, a change in state from the first state to the second state indicating an impact on the door above the predetermined magnitude.

16. The impact detection system of claim 15, and including a blocking member attachable to a sideframe for pivotal movement relative thereto between a first position wherein the blocking member allows passage of the radiation beam, and a second position wherein the blocking member blocks passage of the radiation beam, the blocking member being disposable on the sideframe such that the position of the sideframe door in one of the open and closed positions determines the position of the blocking member.

17. The impact detection system of claim 16, wherein the blocking member is adapted to be in the first position with the sideframe door closed, and is adapted to be in the second position with the sideframe door open.

* * * * *